United States Patent [19]

Pekny

[11] Patent Number: 4,700,652

[45] Date of Patent: Oct. 20, 1987

[54] MARINE ANCHOR

[76] Inventor: Robert E. Pekny, 355 53rd St. N., St. Petersburg, Fla. 33710

[21] Appl. No.: 872,550

[22] Filed: Jun. 9, 1986

[51] Int. Cl.[4] ..... B63B 21/24

[52] U.S. Cl. ..... 114/303; 114/302; 114/309

[58] Field of Search ..... 114/294, 298, 301, 302, 114/303, 309

[56] References Cited

U.S. PATENT DOCUMENTS

| | | | |
|---|---|---|---|
| 2,593,111 | 4/1952 | Crawford et al. | 114/303 |
| 2,905,128 | 9/1959 | Northrop | 114/302 |
| 2,948,249 | 8/1960 | Gesner | 114/298 |
| 3,111,106 | 11/1963 | Burden | 114/302 |
| 3,780,688 | 12/1973 | Hungerford | 114/303 |
| 3,822,666 | 7/1974 | Blomberg | 114/303 |
| 3,858,543 | 1/1975 | Hunderford | 114/303 |
| 3,964,420 | 6/1976 | Stelling | 114/303 |
| 4,058,078 | 11/1977 | Stelling | 114/303 |

*Primary Examiner*—Joseph F. Peters, Jr.
*Assistant Examiner*—Thomas J. Brahan

[57] ABSTRACT

An improved marine anchor that may be quickly assembled or disassembled from its component parts without the use of tools. The compactness of these parts allows for more convenient storage of the anchor components than is available with other anchors. When assembled, the anchor provides great strength and holding ability. Because this anchor is quickly and easily assembled without tools, it is ideal for emergency situations. Since the flukes are removeable, the user can interchange flukes selecting them for their appropriateness to the sea-bed conditions in which he is anchoring.

1 Claim, 8 Drawing Figures

MARINE ANCHOR

BACKGROUND—FIELD OF INVENTION

This invention relates to marine anchors. The object of this invention is to provide an easily stowable anchor of high-holding power and strength. It is the further object of this invention that the assembly of this anchor shall require no tools or specialized skills. While there is no limitation as to the size of the anchor to which this invention applies, a primary function is to afford greater safety and simplicity to the smaller vessel or sea plane.

BACKGROUND—DESCRIPTION OF PRIOR ART

Previous stowable anchors attempted to approach the problem of anchor storage by the use of folding elements and lightweight construction Approaches of this type are seen in U.S. Pat. Nos. 2,075,827; 2,144,645; 2,170,889; 2,208,663; 2,593,111; 2,905,128. These approaches failed to remedy the problem of weight and size; e.g. elements fold but the weight remains constant while the overall storage space requirement is not significantly altered. Further, the mechanisms used to facilitate folding were of a complex nature which is susceptible to corrosion, fouling, or other damage which may render the anchor inoperable after use in the marine environment. These shortcomings are magnified during the use of anchors in storm conditions and emergency situations.

OBJECTS AND ADVANTAGES

The object of this invention is to provide an anchor of great strength and high-holding power that is easily disassembled, without the use of tools, into its component parts for easy stowage. As shall be seen, there are only five component parts, each of which may be stowed independently or together in a compact configuration. The limited number of component parts allows for quick and easy assembly so as to meet the needs of emergency situations. The anchor, once assembled, has no "weak-links" or sophisticated mechanisms which can be damaged by fouling, impact or corrosion encountered in the marine environment. Because different sea-bed conditions are often encountered, the same basic anchor assembly may be modified by using flukes of a different shape or size. For example, in a soft muddy bottom, broader flukes with more area would provide more holding power than the standard sized flukes. This ability to customize the anchor is not now available with any other anchor. Users are often required to carry several different anchors so as to be able to anchor reliably in different conditions. Further objects and advantages of this invention will become apparent from the consideration of the drawings and ensuing descriptions thereof.

DRAWING FIGURES

DESCRIPTION

Figure 1:
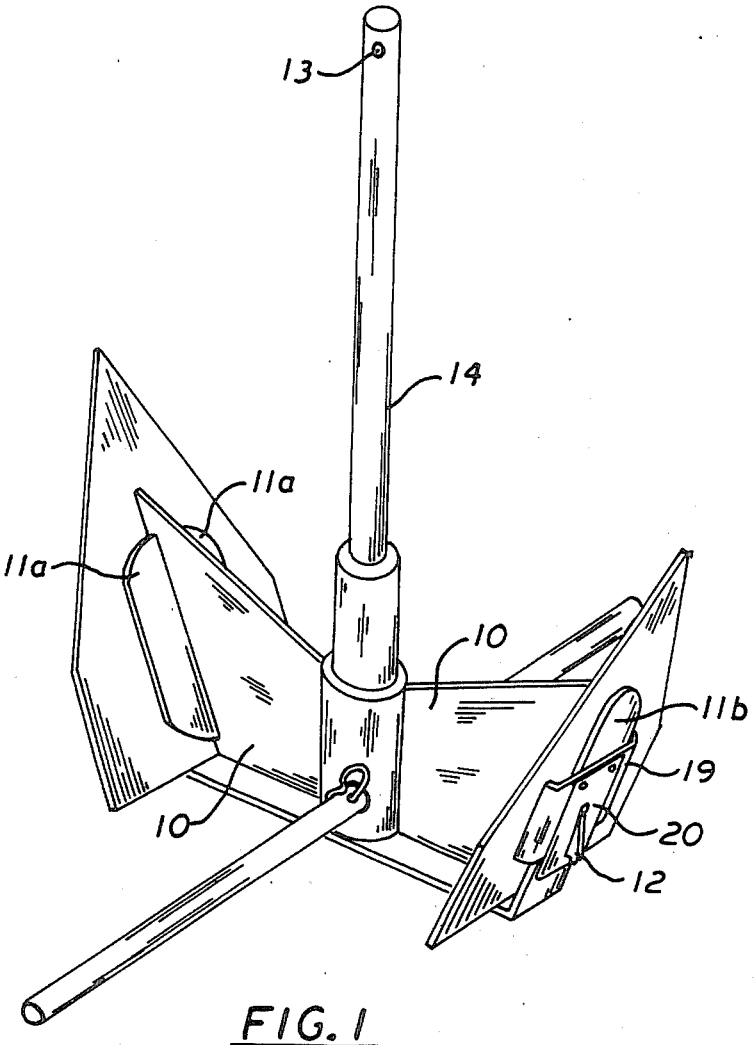
FIG. 1 is a prospective view of the assembled component parts of the anchor.
Figure 3:
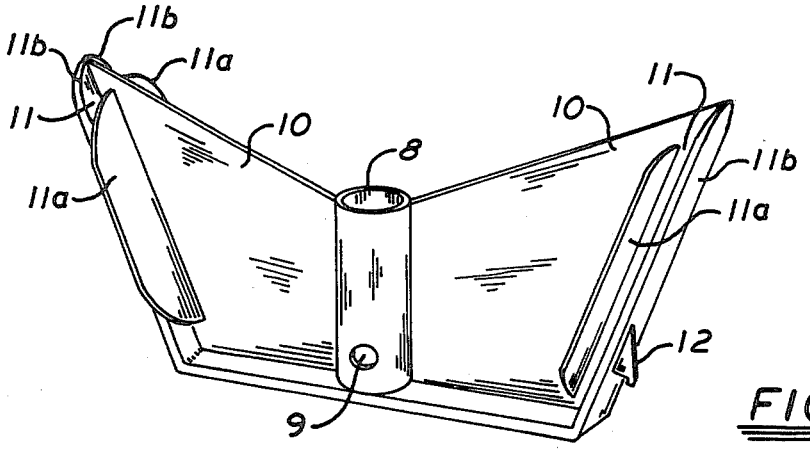
FIG. 3 is a drawing of the anchor body.
Figure 2:
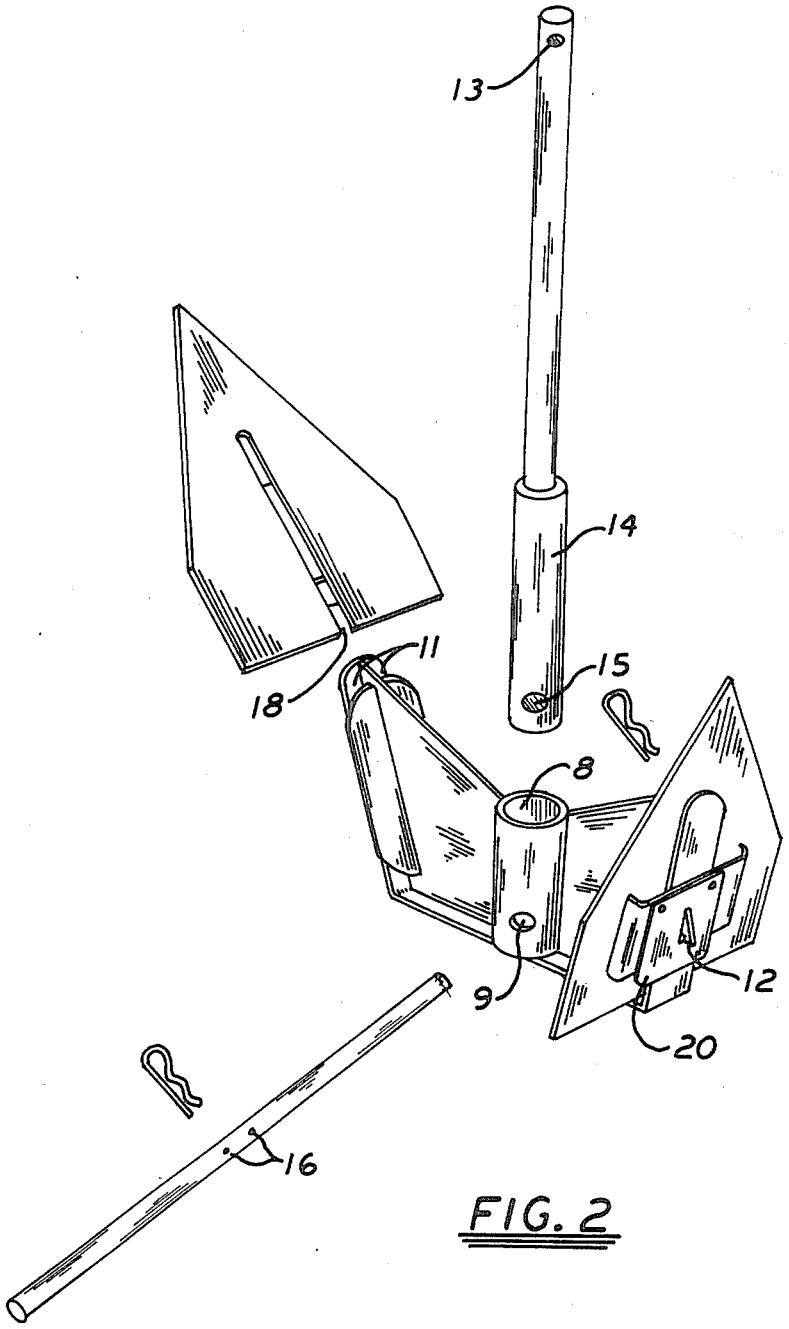
FIG. 2 is an exploded drawing of the invention showing the component parts of the anchor relative to their assembled position. In this drawing, the stock is shown foreshortened.
Figure 4:
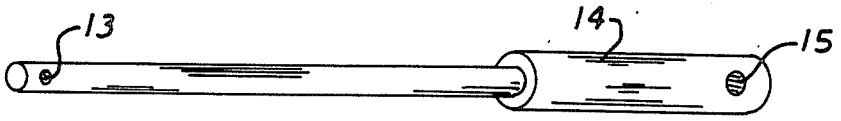
FIG. 4 is a drawing of the anchor shank.
Figure 5:
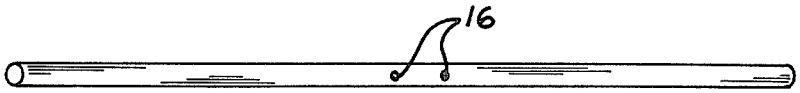
FIG. 5 is a drawing of the anchor stock.
Figure 6:
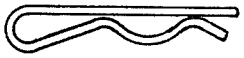
FIG. 6 is a drawing of the anchor stock hitch pin of which there would be two.
Figure 7:
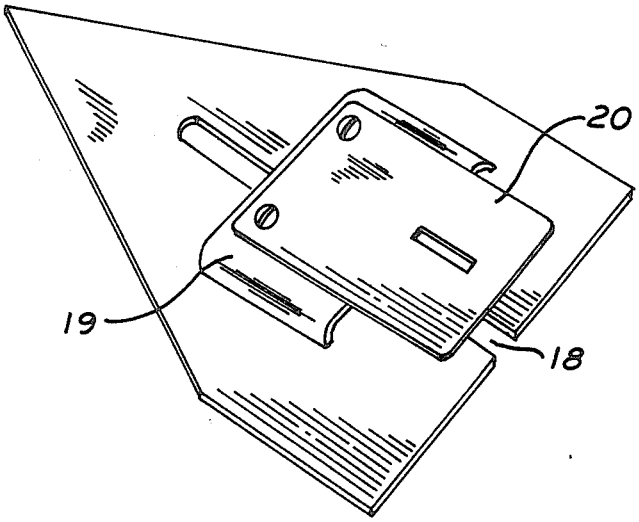
FIG. 7 is a drawing of the anchor fluke of which there would be two.
Figure 8:
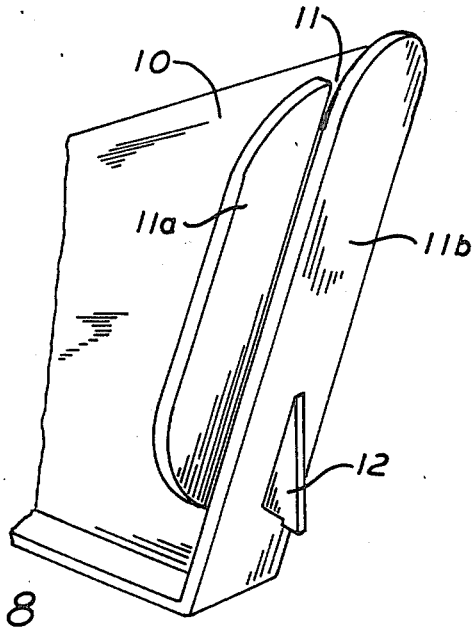
FIG. 8 is an enlargement of the anchor body end showing the fluke lock.

The anchor body (FIG. 3) is a single component piece which forms the base of the anchor. In the center of the anchor body is a vertical opening (8) which is bisected by a through hole (9) drilled at right angles to the anchor body arms (10). At the ends of the anchor body arms (10) are the fluke slides (11) into which the flukes (FIG. 7) are fitted. The flukes (FIG. 7) slide between the fluke slide ears (**11*a*, 11*b*). On the outside of the fluke slide ear (11*b*) is a metal projection which serves as the fluke lock (12). The anchor shank (FIG. 4) is a bar which has at its head a hole (13) for the attachment of a shackle for the connection of the anchor to anchor cable or chain. The base (14) of the anchor shank (FIG. 4) has a through hole (15) which is designed to align with the through hole (9) set in the anchor body (FIG. 3) after the insertion of the anchor shank base (FIG. 4,14) into the vertical shaft (8). After insertion of the shank (FIG. 4) and alignment of the through holes (9, 15), the anchor stock (FIG. 5) is inserted into the now aligned holes (9, 15) and the hitch pin holes (16) of the anchor stock are positioned on either side of the anchor body (FIG. 3). Hitch pins (FIG. 6) are then inserted into the hitch pin holes (16) on each side of the anchor body, thus locking the anchor body (FIG. 3), the anchor shank (FIG. 4), and the anchor stock (FIG. 5) together. The anchor flukes (FIG. 7) are now slid between the fluke slide ears (11*a*, 11*b*). The anchor fluke slots (18) are slid over that section of the anchor body (FIG. 3) which is between the fluke slide ears (11*a*, 11*b*). When sliding the flukes (FIG. 7) into the fluke slide (11), the fluke strap (19) with the fluke spring (20) is eased over the fluke lock (12) until the fluke lock spring (20) engages the fluke lock (12**). The now assembled anchor is ready for use.

In order to disassemble the anchor, it is only necessary to lift the fluke spring (20) off the fluke lock (12) and ease the fluke (FIG. 7) out of the fluke side (11). The next step to disassembly is the removal of the hitch pins (FIG. 6), allowing removal of the component parts in reverse order from their assembly.

It can be seen from this description that the process described and the components used would be feasible for any weight of anchor and provide quick assembly with great strength and ground-holding ability. While the above description contains many specifics, these should not be construed as limitations on the scope of the invention, but instead as one preferred embodiment thereof. Those skilled in the art will be able to envision several other possible variations. A skilled artisan could change the basic shape of the anchor body (FIG. 3) or flukes (FIG. 7) without adversely affecting their functions. The anchor may be constructed out of several different materials. A variety of construction methods may also be used including weldments, castings, or a combination thereof. The method shown to lock the flukes (FIG. 7) to the anchor body (FIG. 3) utilizing a fluke spring (20) and a fluke lock (12) is but one of many ways to lock together these component parts. The hitch pins (FIG. 6) are also only one of many methods to secure the anchor stock (FIG. 5) in position. As such, the reader is requested to determine the scope of the invention by the included claim and its legal equivalent, and not solely by the examples which have been given.

I claim:

1. A marine anchor assembled of its component parts comprising:

a. an anchor body consisting of a vertical central shaft surrounded by two opposing arms, b. a shank which is inserted into said vertical shaft in said anchor body, said shank having at its upper end an opening through which is attached a means of connecting said anchor to its cable or chain, c. an anchor stock which is inserted through aligned openings, these openings being both at the base of said shank and the base of said shaft, and being at right angles to said opposing arms, and d. said anchor stock being held fixably in place at its approximate center to said anchor body with conveniently removable latching means, and e. said anchor stock fixably locking said anchor shank into said shaft in said anchor body, and f. a pair of flukes demountably attached to the ends of said arms of said anchor body, and g. said flukes being held to said arms with conveniently removable latching means, whereby an anchor of great strength and holding power is quickly assembled from its compact and easily stowable component parts.

* * * * *